US006068315A

United States Patent [19]

Vaughter

[11] Patent Number: 6,068,315

[45] Date of Patent: May 30, 2000

[54] POST HOLE DIGGER

[76] Inventor: Jeffrey L. Vaughter, 418 W. Cedar St.-Whiting, Stevens point, Wis. 54481

[21] Appl. No.: 09/252,092

[22] Filed: Feb. 18, 1999

[51] Int. Cl.[7] ..... A01B 1/18

[52] U.S. Cl. ..... 294/50.8; 294/57

[58] Field of Search ..... 294/11, 16, 19.1, 294/50.5–50.9, 53.5, 57, 59, 106, 118, 119; 111/101, 106; 56/400.12; 172/371, 372; 254/132

[56] References Cited

U.S. PATENT DOCUMENTS

| | | | |
|---|---|---|---|
| 171,942 | 1/1876 | Lee | 294/50.7 |
| 370,514 | 9/1887 | Wygant | 294/50.8 |
| 429,328 | 6/1890 | Webb | 294/50.9 |
| 774,646 | 11/1904 | Cady | 294/50.9 X |
| 934,029 | 9/1909 | West | 294/50.8 X |
| 1,222,711 | 4/1917 | Armstrong | 294/50.8 |
| 1,484,100 | 2/1924 | Wertz | 294/11 X |
| 1,761,503 | 6/1930 | Tonhardt . | |
| 2,703,251 | 3/1955 | Green | 294/50.8 |
| 2,735,712 | 2/1956 | Hart | 294/50.5 |
| 3,042,440 | 7/1962 | Weil et al. | 294/50.9 |
| 4,042,270 | 8/1977 | Weiland . | |
| 5,152,569 | 10/1992 | Guiboche | 294/50.8 X |
| 5,320,363 | 6/1994 | Burnham . | |
| 5,743,579 | 4/1998 | Ranburger . | |

*Primary Examiner*—Johnny D. Cherry
*Attorney, Agent, or Firm*—Joseph H. McGlynn

[57] ABSTRACT

A post hole digger having a pair of digging blades which are pivoted with respect to each other, and attached to a pair of handles. The handles have a pair of movable collars which can be moved longitudinally along the handles, and which are pivotally attached to each other.

10 Claims, 2 Drawing Sheets

1
2
3
4
5
6
7
8
9
10
11
12
13
14
15
16
17
24

2
3
4
7
8
10
11
12
13
15
16

POST HOLE DIGGER

BACKGROUND OF THE INVENTION

This invention relates, in general, to hand tools, and, in particular, to a tool for digging post holes.

DESCRIPTION OF THE PRIOR ART

In the prior art various types of post hole diggers have been proposed. For example, U.S. Pat. No. 1,761,503 to Tonhardt discloses a post hole digger having semi-conical digging blades.

U.S. Pat. No. 4,042,270 to Weiland discloses a post hole digger having arms that cross over each other so the handles are on the same side as the blades attached to the handles.

U.S. Pat. No. 5,320,363 to Burnham discloses a post hole digger which has shaft assemblies pivot with respect to each other to produce a mechanical advantage.

U.S. Pat. No. 5,743,579 to Ranburger discloses a post hole digger which has blades that are pivoted with respect to each other between open and closed position.

SUMMARY OF THE INVENTION

The present invention is directed to a post hole digger having a pair of digging blades which are pivoted with respect to each other, and attached to a pair of handles. The handles have a pair of sliding collars which can be moved longitudinally along the handles, and which are pivotally attached to each other.

It is an object of the present invention to provide a new and improved post hole digger.

It is an object of the present invention to provide a new and improved post hole digger which allows a user to dig deeper holes without tapering the top of the hole.

It is an object of the present invention to provide a new and improved post hole digger which allows extensions to be applied to the handles to permit digging deeper holes.

These and other objects and advantages of the present invention will be fully apparent from the following description, when taken in connection with the annexed drawings.

DESCRIPTION OF THE PREFERRED EMBODIMENT

Figure 1:
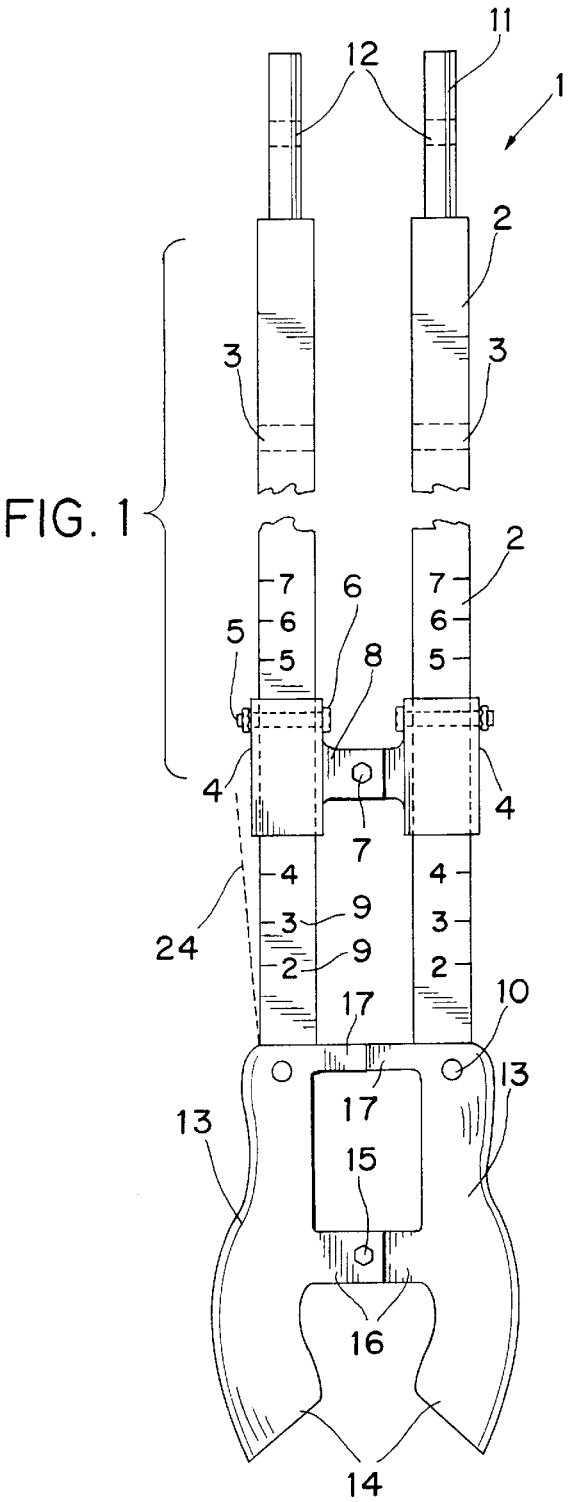
FIG. 1 is a side view of the present invention showing the post hole digger in the open position.
Figure 4:
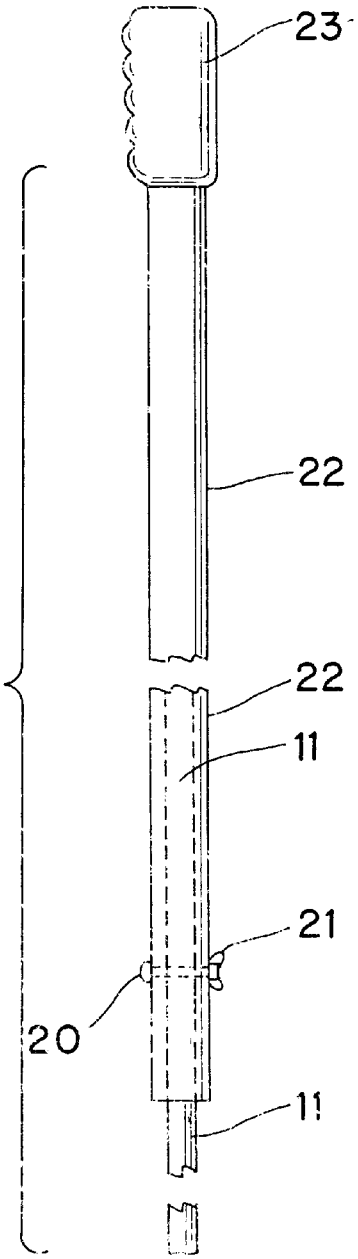
FIG. 4 is a view of the extension handle of the present invention.

Referring now to the drawings in greater detail, FIG. 1 shows the post hole digger 1 of the present invention showing the digger in the open position, i.e. just before a user will force the digger into the ground. As seen in FIG. 1, the digger comprises a pair of handles 2 with each handle having an upper extension 11. The handles 2 are preferably rectangular, however, other shapes could be used. The upper extensions 11 are circular for ease in handling and in order to be able to receive extension handles 22 as shown in FIG. 4, however, other shapes could be used. The extensions 11 have at least one aperture 12 extending therethrough in order to secure the extension handles 22 thereto with a bolt 20 and wingnut 21 as shown in FIG. 4.

The handles 2 have a plurality of apertures 3 extending therethrough, as shown in FIG. 1, to allow the movable collars 4 to be attached at various positions along the handles 2. It should be noted that although the collars 4 are described as being movable to different positions along the length of the handles 2, the collars could be fixed in one position and still work in the intended manner, as will be explained in more detail below.

Figure 2:
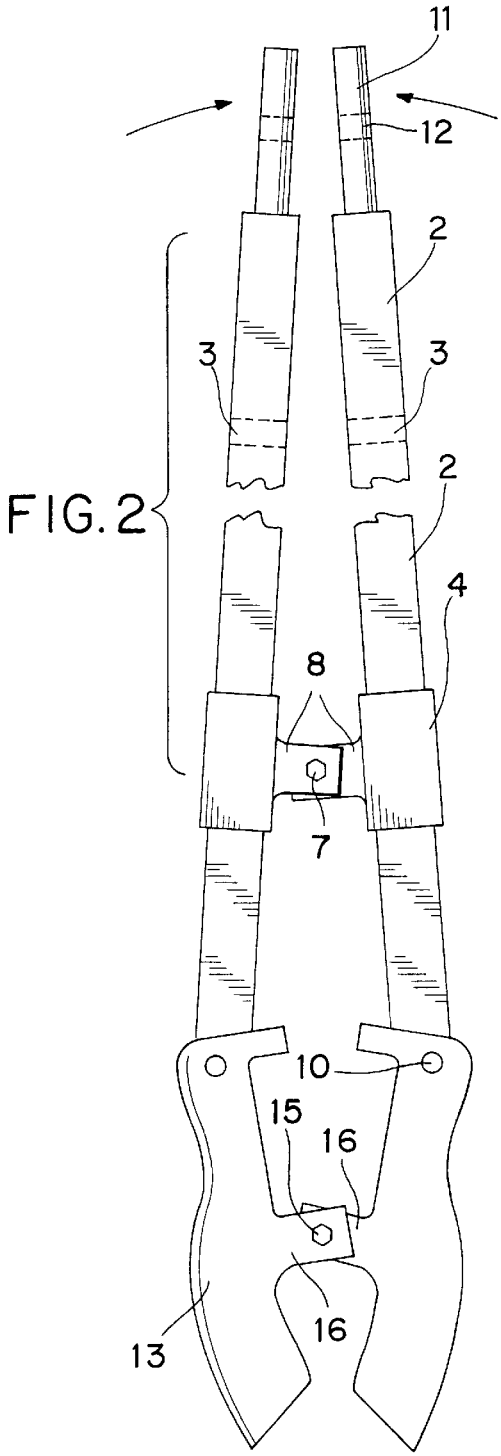
FIG. 2 is a side view of the present invention showing the post hole digger in the closed position.
Figure 3:
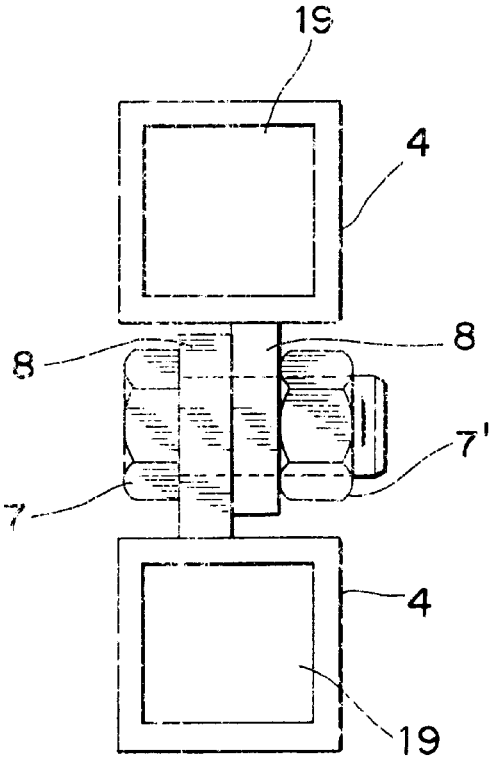
FIG. 3 is a view of the adjustable collar of the present invention.

As shown in FIGS. 1 and 3, each of the movable sleeves or collars 4 has a flange 8 secured thereto. The flanges 8 can be integral or unitary with the collars 4. A bolt 7 and a nut 7' secure the flanges 8 together, but allow the flanges to pivot with respect to each other as shown in FIGS. 1 and 2. A bolt 5 and wingnut 6 pass through the collars 4 and through the apertures 3 in the handles 2 in order to secure the collars at selected positions along the length of the handles 2.

At the lower end of the handles 2 digging blades 13, having pointed ends 14, are secured by any conventional fastening means 10, which allows the handles to pivot at point 10. Each of the blades 13 has a flange 16 affixed thereto, similar to the flanges 8 on the collars 4. The flanges 16 are secured together by a bolt 15 and a nut (not shown) similar to the bolt 7 and nut 7', which will allow the flanges 16 to pivot with respect to each other similar to the pivoting action between the flanges 8.

Also, it should be noted that the lower portions of the handles 2 taper slightly toward each other as shown by the dotted line 24 in FIG. 1. This tapering, which is exaggerated in FIG. 1 for illustration purposes, allows the diameter of the hole dug by the post hole digger to be about the same size at ground level as at the bottom of the hole. This will allow the post, which will be inserted into the hole to be more firmly secured in the hole. The length of the handle, along which the taper occurs, down to pivot point 10 should be less than the length from pivot point 10 to the tip of the digging blades 13.

Normally, when a conventional post hole digger is used, the size of the hole at ground level will be wider than the size of the hole at the bottom of the hole. This is required since the handles of the conventional post hole digger will have to be spread further apart than the handles of the present invention. Therefore, in order to position the conventional post hole digger into the hole to dig the hole deeper, the hole will have to be wider at the top than at the bottom. Because of this geometry, a user will have to apply more fill at the top of the hole in order to secure the post in the hole. The extra fill at the top of the hole will make the post less steady until the fill settles. This disadvantage will not be present in the present invention.

A stop member 17 is positioned at the top of each of the digging blades 13. These stop members 17 will abut, as shown in FIG. 1 when the blades 13 are in the open position, to prevent over extension of the handles and blades. Also, indicia marks 9 are placed along the body of the handles 2 to indicate to the user the depth of the hole. The marks shown in FIG. 1 are labeled "2", "3", and "4" to indicate a dimension in feet. However, other dimensions or indicia, such as inches, meters, etc. could be used without departing from the scope of the present invention.

In order to use the post hole digger of the present invention, a user would apply the same action as in the conventional post hole digger. That is, he would position the handles as shown in FIG. 1 in the open position, and then drive the blades 13 into the ground. Next, he would pivot the handles together, as shown in FIG. 2, thereby closing the blades 13 in order to extract dirt. This process would be repeated until the hole is at the desired depth.

The problem with a conventional post hole digger is that the handles are spread apart a great distance at the top of the handles, i.e. where the user is grasping the handles. This causes the top of the hole to be wider than the bottom of the hole, resulting in the problem described above.

Another problem with the conventional post hole digger is proper leverage when digging deep holes. Generally, the deeper the hole, the less leverage a user can apply at the top of the handles. This is especially true if extension handles such as the handles 22 are secured to the extensions 11 on the handles 2. In order to provide more leverage, the present invention utilizes the movable collars 4. The collars are hollow, as shown in FIG. 3 at 19 to receive the handles 2, and can be positioned at selected positions along the handles 2 by passing a bolt 5 through one of the apertures 3 spaced along the handle. If more leverage is needed to dig a particular depth hole, the collars 4 can be moved from the position shown in FIG. 1 to the upper position shown by the apertures 3. Since the collars pivot with respect to each other, as shown in FIGS. 1 and 2, they will not interfere with the normal operation of the post hole digger.

In order to extend the reach of the post hole digger so deeper holes could be dug, the extension handles 22 could be attached to the extensions 11. The extension handles 22 are hollow and will slide over the extensions 11. In order to secure the extension handles 22 to the extensions 11, a bolt 20 and wingnut 21 can be used. It should be noted that only one position is shown in FIG. 4 where the extension handles 22 are secured to the extensions 11; however, a plurality of positions could be provided to give the user more options in selecting the height of the extension handles 22. In addition, a hand grip 23, similar to a hand grip on a bicycle, could be placed on the extension handle 22 to provide a more comfortable and secure grip for the user.

Although the Post Hole Digger and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A post hole digger comprising:

a pair of handles, each of said pair of handles having a blade attached thereto at one end, said handles being pivotally attached together at a first point by flanges attached to said blades, means for pivotally attaching said handles together at a second point, said second point being positioned above said first point, and wherein said means for pivotally attaching said handles together at a second point comprises a sleeve attached to each handle, each sleeve having a flange, means for pivotally attaching said flanges together, and wherein said means for pivotally attaching said handles together at a second point is movable to different selected positions along said handles.

2. The post hole digger as claimed in claim 1, wherein said handles have an upper portion which is smaller in a lateral dimension than a lower portion of said handles.

3. The post hole digger as claimed in claim 2, wherein said upper portion of each handle is circular.

4. The post hole digger as claimed in claim 2, wherein an extension handle is attached to said upper portions of said handles.

5. The post hole digger as claimed in claim 4, wherein said extension handles are large enough to fit over said upper portions of said handles, and fastening means for securing said extension handles to said upper portions.

6. The post hole digger as claimed in claim 1, wherein said handles have a plurality of apertures spaced along said handles, means for securing said sleeves in a selected one of said plurality of apertures.

7. The post hole digger as claimed in claim 1, wherein said handles have indicia means thereon for indicating a depth of a hole dug by said post hole digger.

8. A post hole digger comprising:

a pair of handles, each of said pair of handles having a blade attached thereto at one end, said handles being pivotally attached together at a first point by flanges attached to said blades, means for pivotally attaching said handles together at a second point, said second point being positioned above said first point, and wherein said handles taper inwardly from a position below said second point to a position above said first point.

9. The post hole digger as claimed in claim 8, wherein said means for pivotally attaching said handles together at a second point comprises a sleeve attached to each handle, each sleeve having a flange, means for pivotally attaching said flanges together.

10. The post hole digger as claimed in claim 9, wherein said means for pivotally attaching said handles together at a second point is movable to different selected positions along said handles.

* * * * *